US009852864B2

(12) United States Patent
Hoppe et al.

(10) Patent No.: US 9,852,864 B2
(45) Date of Patent: Dec. 26, 2017

(54) ELECTROMAGNETIC SWITCHING DEVICE

(71) Applicant: Schaeffler Technologies AG & Co. KG, Herzogenaurach (DE)

(72) Inventors: Jens Hoppe, Erlangen (DE); Josef Groeschel, Groessweinstein (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/893,849

(22) PCT Filed: Feb. 26, 2014

(86) PCT No.: PCT/DE2014/200091
§ 371 (c)(1),
(2) Date: Nov. 24, 2015

(87) PCT Pub. No.: WO2014/202061
PCT Pub. Date: Dec. 24, 2014

(65) Prior Publication Data

US 2016/0126043 A1 May 5, 2016

(30) Foreign Application Priority Data

Jun. 21, 2013 (DE) ..... 10 2013 211 816

(51) Int. Cl.

| | |
|---|---|
| ***H01H 50/36*** | (2006.01) |
| ***H01H 50/18*** | (2006.01) |
| ***H01F 7/08*** | (2006.01) |
| ***H01H 49/00*** | (2006.01) |
| ***H01H 50/44*** | (2006.01) |

(52) U.S. Cl.
CPC ..... *H01H 50/18* (2013.01); *H01F 7/081* (2013.01); *H01H 49/00* (2013.01); *H01H 50/36* (2013.01); *H01H 50/44* (2013.01); *H01F 2007/085* (2013.01); *H01H 2050/362* (2013.01)

(58) Field of Classification Search
CPC ..... H01H 50/36; H01H 2050/362
See application file for complete search history.

(56) References Cited

U.S. PATENT DOCUMENTS

| | | | |
|---|---|---|---|
| 3,851,285 | A | 11/1974 | Rothfuss et al. |
| 7,009,478 | B2 | 3/2006 | Ermert et al. |
| 2005/0218363 | A1 | 10/2005 | Furuta et al. |

(Continued)

FOREIGN PATENT DOCUMENTS

| | | |
|---|---|---|
| DE | 10238840 | 3/2004 |
| DE | 102005049988 | 4/2007 |
| DE | 202007004754 | 7/2007 |

(Continued)

*Primary Examiner* — Ramon M Barrera
(74) *Attorney, Agent, or Firm* — Davidson, Davidson & Kappel, LLC

(57) ABSTRACT

An electromagnetic switching device (10) and a method for producing the electromagnetic switching device (10) are disclosed. To this end, a magnetic armature (13) and a pressure pin (19) which is movable in a bearing (21) along an axis (A) are provided. A bearing sleeve (11) accommodates at least the bearing (21) and the magnetic armature (13). An electromagnetic casing (12) and the bearing sleeve (11) are together made of a single material in the form of a one-piece component (100).

7 Claims, 4 Drawing Sheets

(56) References Cited

U.S. PATENT DOCUMENTS

2013/0161546 A1* 6/2013 Frippiat ..... F16K 31/0675
251/129.15

FOREIGN PATENT DOCUMENTS

| | | |
|---|---|---|
| DE | 102006015233 | 10/2007 |
| DE | 102007001141 | 7/2008 |
| DE | 102007061862 | 6/2009 |

* cited by examiner

ELECTROMAGNETIC SWITCHING DEVICE

The present invention relates to an electromagnetic switching device. In particular, the present invention relates to an electromagnetic switching device which is provided with a bearing sleeve, which accommodates a magnetic armature, a bearing and a pressure pin guided via the bearing.

The present invention also relates to a method for manufacturing an electromagnetic switching device.

BACKGROUND

In known electromagnetic switching devices, the seal is established, for example, by introducing O ring seals or by media-tight extrusion coating of the coil. One disadvantage of the arrangements known from the prior art is that an increased assembly complexity and thus also higher costs are caused by the additionally required components. The risk, which should not be underestimated, also exists that fluctuations arising during the injection molding process may result in leaks.

An electromagnetic adjusting device is known from DE 10 2006 015 233 B4, in which the yoke section and the core section are implemented as a yoke/core section manufactured as a single piece, whereby the complex axial centering of the components relative to each other is eliminated. A magnetic short circuit is generated between the core and the yoke, which has only a limited impact on efficiency, due to additional geometric arrangements, but does not mitigate this impact entirely. The bearing unit in this case is mounted in the housing.

In DE 10 2007 061 862 A1, a bearing sleeve is integrated into the switchable magnet arrangement with the aid of a welding method. All other parts are inserted into an injection mold, and extrusion-coated with a plastic compound, so that they are held fixedly against each other. A pressure compensation is to be implemented in the magnet without any compensating bores in the armature piston. For this purpose, it is proposed that the armature and/or the yoke and/or the conical guiding element and/or the bearing is/are surrounded by a magnetically conductive, media-permeable material.

As a result, the devices according to the prior have an increased assembly complexity. Due to the injection molding process and the media-permeable material, a complete and secure sealing of the magnet against the surroundings may not be achieved.

SUMMARY OF THE INVENTION

It is an object of the present invention to provide an electromagnetic switching device which is easy and economical to manufacture and which nevertheless has the necessary tightness against the oil-wetted interior of the magnet and the surroundings.

Another alternate or additional object of the present invention is to provide a method for manufacturing an electromagnetic switching device which is simple and cost-effective.

An electromagnetic switching device includes at least one magnetic armature, a yoke, a pressure pin which is movably guided along an axis in a bearing, and a bearing sleeve. The bearing sleeve accommodates at least the bearing and the magnetic armature.

According to the present invention, at least the electromagnet casing and the bearing sleeve are formed as a one-piece component from a material with the aid of a forming process, preferably with the aid of a deep drawing technique. All other components which are still present in the electromagnetic switching device are inserted into the component of a one-piece design, which includes at least the electromagnet casing and the bearing sleeve. At least the magnetic armature and the bearing are inserted into the bearing sleeve, in that the pressure pin is guided along an axis. A coil, a coil carrier, an intermediate segment and, if necessary, a pole core and/or a yoke are inserted between the electromagnet casing and the bearing sleeve. A sealing function is integrated into the bearing sleeve, whereby additional components forming the sealing function are eliminated. It is also no longer necessary to extrusion coat the components with the aid of an injection molding process. As a result, the assembly complexity and the risk of leaks, which may arise due to the injection molding process, are reduced.

In a first specific embodiment of the electromagnetic switching device, the electromagnet casing, the bearing sleeve and the pole core are formed together as a one-piece component from a material. The pole core is formed on the outer diameter of the bearing sleeve. In this specific embodiment, the yoke is mounted as a separate component between the bearing sleeve and the electromagnet casing.

In a second specific embodiment of the electromagnetic switching device, the electromagnet casing, the bearing sleeve, the yoke and the pole core are formed together as a one-piece component from a material. The pole core and the yoke are formed on the outer diameter of the bearing sleeve. A yoke plate abuts the yoke formed on the bearing sleeve.

The magnetic armature may be supported and/or guided in the inside of the bearing sleeve. This may take place, for example, with the aid of a friction bearing which is provided between the magnetic armature and the inside of the bearing sleeve. A magnetically non-conductive anti-friction layer may likewise be provided between the magnetic armature and the inside of the bearing sleeve.

In a third specific embodiment of the electromagnetic switching device according to the present invention, the electromagnet casing and the bearing sleeve are formed together as a one-piece component from a material. The pole core and the yoke are mounted as separate components on the outer diameter of the bearing sleeve.

In the specific embodiments in which the pole core and/or yoke is/are mounted as separate components on the outer diameter of the bearing sleeve, they are preferably deep-drawn, extruded, machined or sintered.

The space of the magnetic armature within the bearing sleeve is sealed toward the bottom by pressing in flux-conducting components. Due to the fact that a deliberate magnetic saturation is generated on an intermediate segment situated on the outer diameter of the bearing sleeve, the two flux-conducting segments, the pole core and the yoke, of the soft iron circuit are separated from each other.

Exemplary embodiments of the present invention and their advantages are explained in greater detail below on the basis of the attached figures. The proportions in the figures do not always correspond to the real proportions, since some shapes in the illustration have been simplified and other shapes have been enlarged in relation to other elements for the purpose of better clarification.

DETAILED DESCRIPTION

Figure 1:
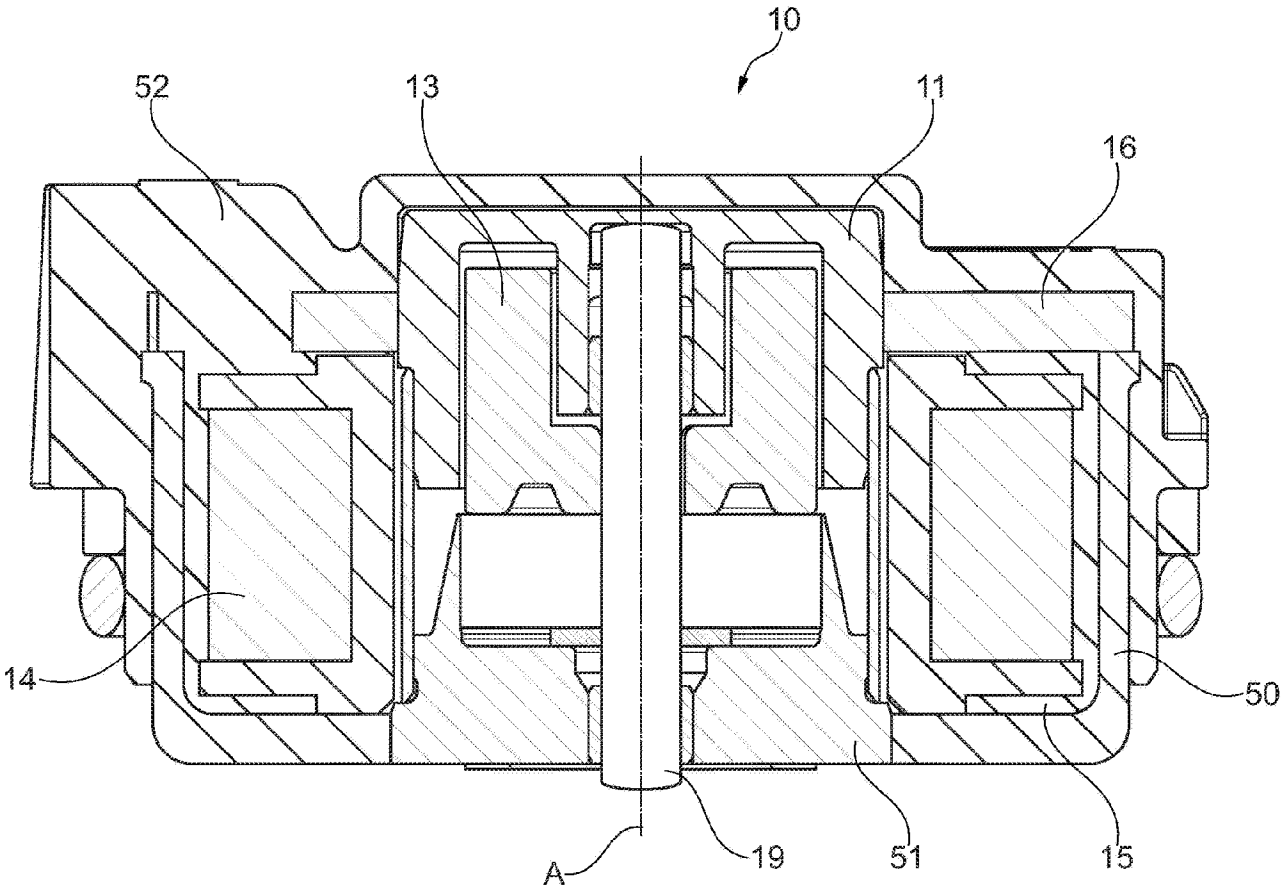
Fig. 1 Prior art
FIG. 1 shows a sectional representation of an electromagnetic switching device according to the prior art.

Identical reference numerals are used for the same elements or elements having the same function. Furthermore, for the sake of clarity, only reference numerals which are necessary for describing the particular figure are shown in the individual figures. The illustrated specific embodiments only represent examples of how the electromagnetic switching device according to the present invention may be designed and do not represent a final limitation of the present invention.

FIG. 1 shows an electromagnetic switching device 10 according to the prior art. Bearing sleeve 11, which accommodates magnetic armature 13, is connected to cup-shaped housing part 50 with the aid of a welding method and is thus part of electromagnetic switching device 10. Coil 14, coil carrier 15 and yoke 16 are situated outside bearing sleeve 11. Bearing sleeve 11, cup-shaped housing part 50, coil 14, coil carrier 15 and yoke 16 are inserted into an injection mold, and extrusion-coated with a plastic compound 52, so that they are fixed in place in electromagnetic switching device 10. Cup-shaped housing part 50 is closed with the aid of a conical guiding element 51, in which a pressure pin 19 is guided. Pressure pin 19 is movable axially along an axis A.

Figure 2A:
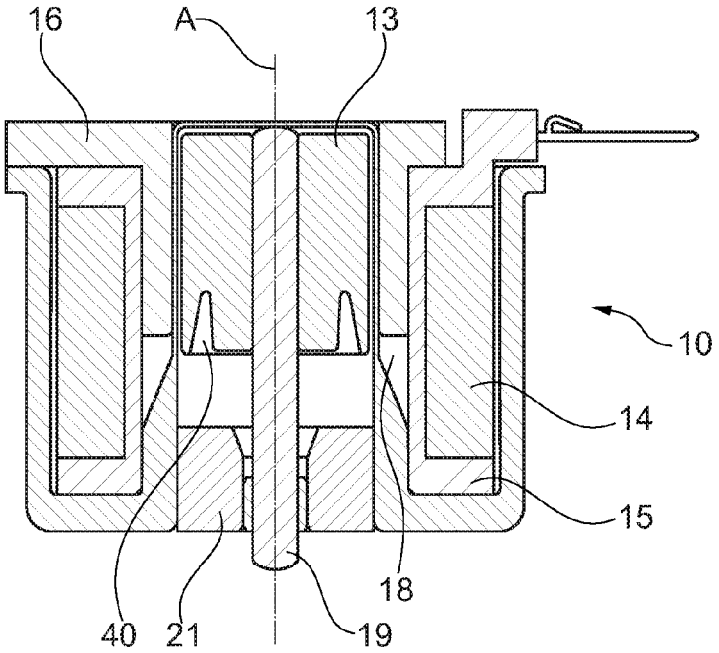
FIG. 2*a* shows a sectional representation of a first specific embodiment of the electromagnetic switching device, in which the electromagnet casing, the bearing sleeve and the pole core are formed as a one-piece component.
Figure 2B:
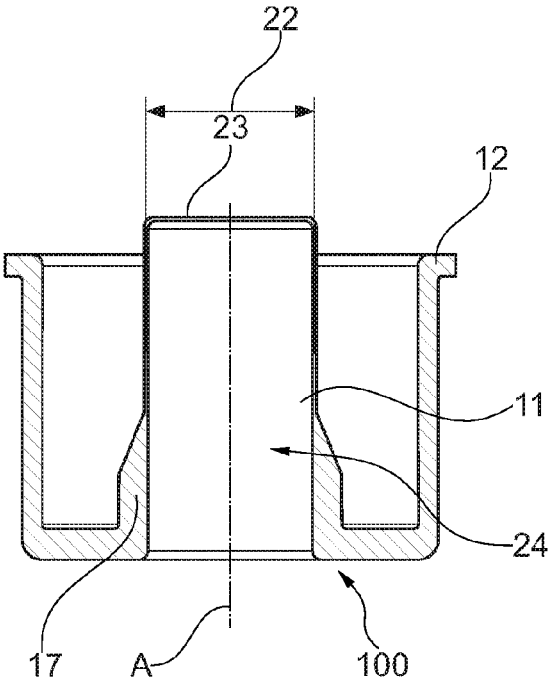
FIG. 2*b* shows a sectional representation of the one-piece component according to the first specific embodiment.
Figure 2C:
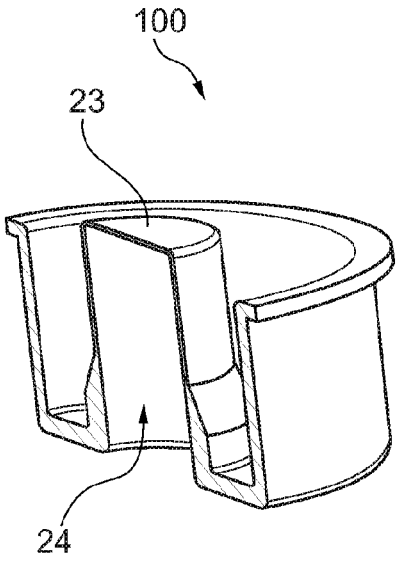
FIG. 2*c* shows a three-dimensional sectional representation of the one-piece component according to the first specific embodiment.

FIG. 2*a* shows an electromagnetic switching device 10 according to the present invention according to a first specific embodiment. One-piece component 100, which is made from a material with the aid of a forming process, is shown in FIGS. 2*b* and 2*c*. This component includes electromagnet casing 12, bearing sleeve 11 and pole core 17. Pole core 17 is formed on outer diameter 22 of bearing sleeve 11. Coil 14, coil carrier 15, yoke 16 and an intermediate segment 18, which separates pole core 17 and yoke 16 from each other, are inserted between bearing sleeve 11 and electromagnet casing 12. Bearing 21 in which pressure pin 19 is movably guided along axis A, and movably supported magnetic armature 13, which is closed by pressing in flux-conducting components 40, are inserted into inside 24 of bearing sleeve 11. Bearing sleeve 11 is closed on one side by a cover 23, which is also formed by the forming process.

Figure 3A:
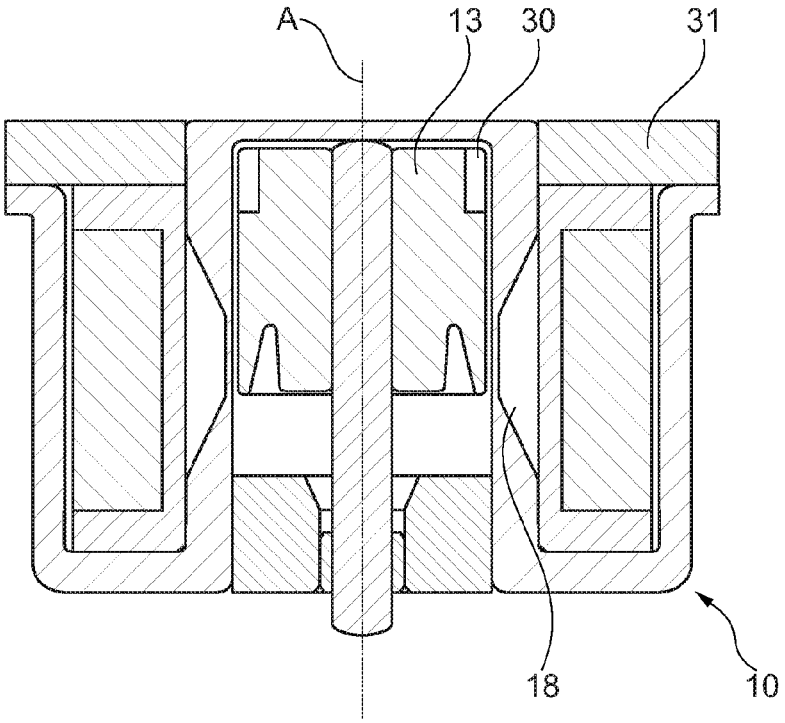
FIG. 3*a* shows a sectional representation of a second specific embodiment of the electromagnetic switching device, in which the electromagnet casing, the bearing sleeve, the pole core and the yoke are formed as a one-piece component.
Figure 3B:
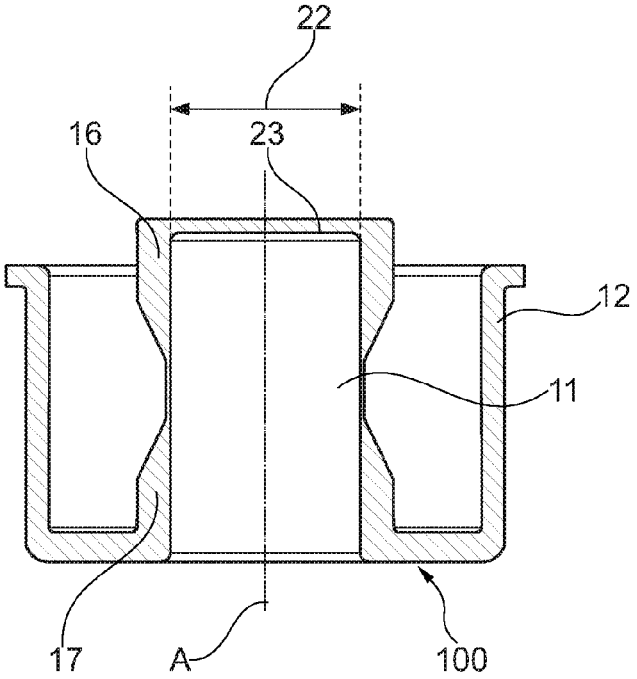
FIG. 3*b* shows a sectional representation of the one-piece component according to the second specific embodiment.
Figure 3C:
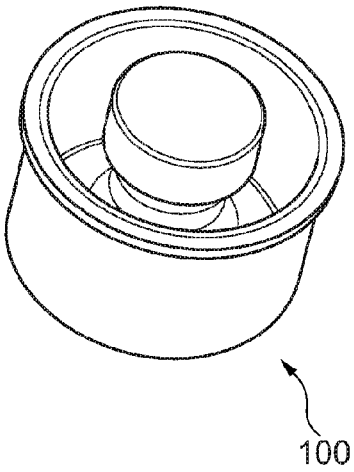
FIG. 3*c* shows a three-dimensional sectional representation of the one-piece component according to the second specific embodiment.

FIG. 3*a* shows an electromagnetic switching device 10 according to the present invention according to a second specific embodiment. One-piece component 100, which is made from a material with the aid of a forming process, is shown in FIGS. 3*b* and 3*c*. In this specific embodiment, the component includes electromagnet casing 12, bearing sleeve 11, pole core 17 and yoke 16. Pole core 17 and yoke 16 are formed on outer diameter 22 of bearing sleeve 11. Since yoke 16 in this specific embodiment is formed directly on outer diameter 22 of bearing sleeve 11, one-piece component 100 is closed at the upper end by a yoke plate 31. A bearing, advantageously a friction bearing 30, may also be provided in bearing sleeve 11, which is used to support or guide magnetic armature 13. All other components which are also present in electromagnetic switching device 10 are positioned in the same way as in the preceding specific embodiment.

Figure 4A:
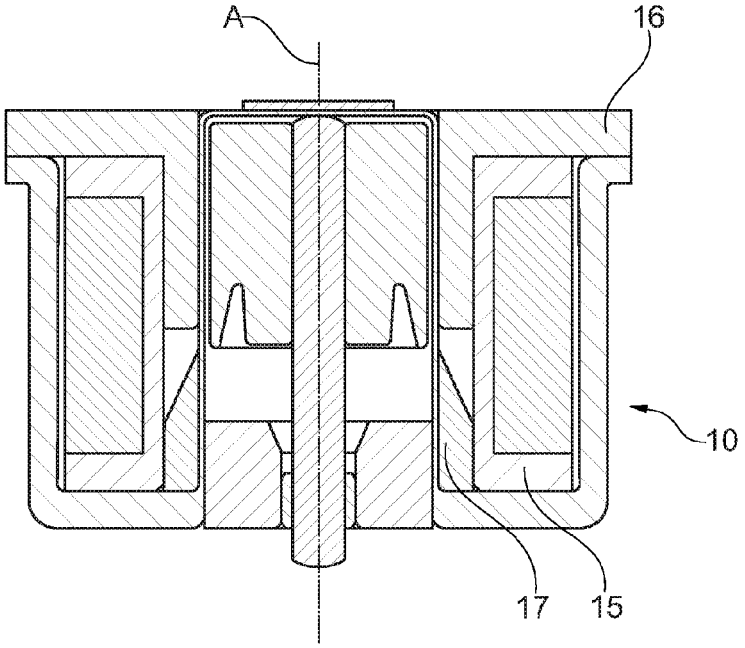
FIG. 4*a* shows a sectional representation of a third specific embodiment of the electromagnetic switching device, in which the electromagnet casing and the bearing sleeve are formed as a one-piece component, and the pole core and the yoke are separate components.
Figure 4B:
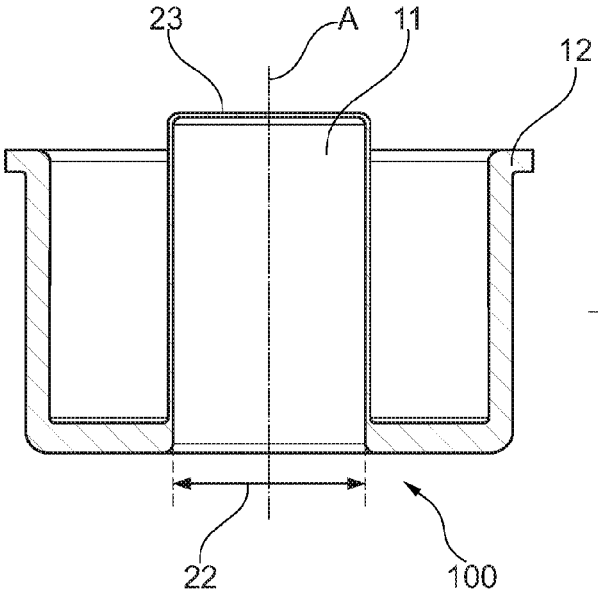
FIG. 4*b* shows a sectional representation of the one-piece component according to the third specific embodiment.
Figure 4C:
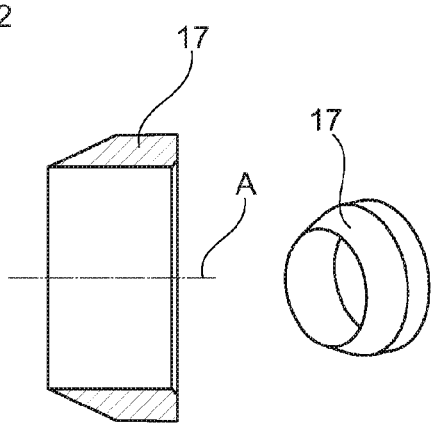
FIG. 4*c* shows a sectional representation and a three-dimensional representation of the pole core, which is mounted as a separate component on the bearing sleeve.

FIG. 4*a* shows an electromagnetic switching device 10 according to the present invention according to a third specific embodiment. One-piece component 100, which is made from a material with the aid of a forming process, is shown in FIG. 4*b*. In this specific embodiment, the component includes electromagnet casing 12 and bearing sleeve 11. FIG. 4*c* shows pole core 17, which in this specific embodiment is mounted as a separate component on outer diameter 22 of bearing sleeve 11. All other components which are also present in electromagnetic switching device 10 are positioned in the same way as in the preceding specific embodiments.

LIST OF REFERENCE NUMERALS

10 electromagnetic switching device
11 bearing sleeve
12 electromagnet casing
13 magnetic armature
14 coil
15 coil carrier
16 yoke
17 pole core
18 intermediate segment
19 pressure pin
21 bearing
22 outer diameter
23 cover
24 inside of the bearing sleeve
30 friction bearing
31 yoke plate
40 flux-conducting component
50 cup-shaped housing part
51 conical guiding element
52 plastic compound
100 one-piece component
A axis

The invention claimed is:

1. An electromagnetic switching device comprising:
a magnetic armature;
a pressure pin movably guided along an axis in a bearing;
a yoke;
a bearing sleeve accommodating at least the bearing and the magnetic armature;
a coil, including a coil carrier; and
an electromagnet casing surrounding an outer diameter of the coil;

the electromagnet casing and bearing sleeve being formed together as a one-piece component from a material, the bearing sleeve including a cover closing a first end of the bearing sleeve, the bearing sleeve including a second end opposite of the first end being connected to the electromagnet casing.

2. The electromagnetic switching device as recited in claim 1 wherein a conical pole core is formed on the bearing sleeve from the material of the electromagnet casing and the bearing sleeve.

3. The electromagnetic switching device as recited in claim 1 wherein the yoke is conical, a conical pole core and the conical yoke being formed on the bearing sleeve from the material of the electromagnet casing and the bearing sleeve.

4. The electromagnetic switching device as recited in claim 3 wherein the pole core and the yoke are separated from each other by a magnetically saturated intermediate segment.

5. The electromagnetic switching device as recited in claim 1 wherein the magnetic armature is provided at the first end of the bearing sleeve and the bearing is provided at the second end of the bearing sleeve.

6. The electromagnetic switching device as recited in claim 3 wherein the conical yoke is provided at the first end of the bearing sleeve.

7. The electromagnetic switching device as recited in claim 3 wherein the conical yoke is provided at the first end of the bearing sleeve and the conical pole core is provided at the second end of the bearing sleeve.

* * * * *